United States Patent [19]

Efferding

[11] Patent Number: 4,800,283

[45] Date of Patent: Jan. 24, 1989

[54] SHOCK-ABSORBING AND HEAT CONDUCTIVE BASKET FOR USE IN A FUEL ROD TRANSPORTATION CASK

[75] Inventor: Larry E. Efferding, Pensacola, Fla.

[73] Assignee: Westinghouse Electric Corp., Pittsburgh, Pa.

[21] Appl. No.: 44,694

[22] Filed: May 1, 1987

[51] Int. Cl.[4] ..... G21F 5/00

[52] U.S. Cl. ..... 250/507.1; 250/506.1; 376/272

[58] Field of Search ..... 250/506.1, 507.1; 376/272

[56] References Cited

U.S. PATENT DOCUMENTS

| | | | |
|---|---|---|---|
| 3,119,933 | 1/1964 | Allen | 250/507.1 |
| 4,177,385 | 12/1979 | Bevilacqua | 250/507.1 |
| 4,268,755 | 5/1981 | Weber | 250/506.1 |
| 4,292,528 | 6/1979 | Shaffer et al. | 250/506.1 |
| 4,399,366 | 4/1981 | Bucholz | 250/507.1 |
| 4,488,048 | 12/1984 | Bienek et al. | 250/506.1 |
| 4,543,488 | 10/1984 | Diem | 250/507.1 |
| 4,610,893 | 12/1984 | Eriksson et al. | 427/34 |
| 4,666,659 | 5/1986 | Lusk et al. | 250/507.1 |
| 4,711,758 | 12/1987 | Machado et al. | 250/507.1 |

FOREIGN PATENT DOCUMENTS

| | | |
|---|---|---|
| 186487 | 2/1986 | European Pat. Off. . |
| 175140 | 3/1986 | European Pat. Off. . |

OTHER PUBLICATIONS

U.S. patent application Ser. No. 670,727, filed Nov. 13, 1984 by Efferding.

*Primary Examiner*—Bruce C. Anderson

[57] ABSTRACT

An improved shipping cask for transporting fuel rods is disclosed herein. The cask comprises a cylindrical vessel, and a basket structure disposed in the interior thereof for holding a plurality of spent fuel containers. A plurality of plate-like former members circumscribe the basket structure, and include shock-absorbing portions formed from a network of ligaments which deformably yield when mechanical shock of a selected magnitude is applied onto the side of the cylindrical vessel that contains the basket structure. Additionally, the former members are formed from a metal having a greater thermal coefficient of expansion than the wall of the cylindrical vessel, and are dimensioned so that the basket structure is freely receivable within the interior of the cylindrical vessel at ambient temperature, but becomes frictionally bound within this interior as a result of greater relative thermal expansion whenever heat-radiating fueld rods are loaded into the fuel rod containers of the basket structure. The former members further serve to dissipate heat generated by the fuel rods through the walls of the cylindrical vessel.

24 Claims, 6 Drawing Sheets

SHOCK-ABSORBING AND HEAT CONDUCTIVE BASKET FOR USE IN A FUEL ROD TRANSPORTATION CASK

BACKGROUND OF THE INVENTION

1. Field of the Invention

This invention generally relates to casks for transporting the nuclear fuel rods to or from nuclear power plant facilities and is specifically concerned with an improved basket structure for use in such a cask having shock absorbing former plates with improved heat transfer characteristics for protecting the fuel rods held within the basket structure.

2. Description of the Prior Art

Vessels for shipping the spent fuel assemblies produced by nuclear power plants are known in the prior art. Such vessels generally include a transportable steel vessel that is cylindrical in shape, and a basket structure that is receivable within the steel vessel for holding an array of rectangular storage containers. Each of these storage containers, in turn, may hold either a fuel rod assembly, or a consolidated fuel cannister. The general purpose of such transportable vessels is to provide a means for shipping spent fuel rods from a nuclear power plant to a permanent waste isolation site or reprocessing facility in as safe a manner as possible. At the present time, relatively few of such transportable vessels have been manufactured and used since most of the spent fuel generated by nuclear power plants is being stored in the spent-fuel pools of the reactor facilities. However, the availability of such on-site storage space is steadily diminishing as an increasing number of fuel assemblies are being loaded into the spent-fuel pools of such facilities every day. Additionally, the Nuclear Regulatory Commission (N.R.C) has been recently obligated (by way of an Act of Congress) to move the spent fuel assemblies from the on-site storage facilities of all nuclear power plants to a federally operated nuclear waste disposal facility starting in 1998.

While the transportation vessels of the prior art are generally capable of safely transporting spent fuel to a final destination, there is considerable room for improvement. Applicant has observed, for example, that no transportation vessel that he is aware of has any mechanism for absorbing mechanical shock applied to the sides of the vessel. This would constitute a substantial improvement, since many of the Zircaloy® tubes that form the outer cladding of the fuel rods are brittle and fragile as a result of both radiation degradation, and fretting against the grids of the fuel assembly during service. Hence, if any substantial mechanical shock is applied to the walls of such vessels, there is a substantial likelihood that at least some of the Zircaloy® fuel rods will crack or break completely, thereby spilling particles of the uranium oxide that forms the fuel pellets disposed within the Zircaloy® tubes. Dissipation of such radioactive particles within the vessel in turn increases the chances of exposing the personnel in charge of loading these spent fuel assemblies to potentially hazardous radiation. Still another area where such prior art transportation vessels could be improved is in the structure required to achieve integrality of the vessel and its contents after the vessel is loaded. The present mechanical structures necessary to eliminate all "slack" within the vessel interior are relatively complex, expensive to construct, and time consuming to implement. The elimination of such slack is completely necessary, since it is very important that the basket structure holding the fuel assemblies not rattle against the interior of the vessels during the transportation thereof. However, any simplified mechanism for eliminating the complex anti-slack structure must also have the ability to readily dissipate the residual heat generated by the spent fuel rods. Further, since the spent fuel assemblies are lifted directly out of the spent fuel pool as they are being loaded on such vessels, all components of the vessel must be completely drainable.

Clearly, there is a present and growing need for a transportation vessel that can safely and economically transport large amounts of spent fuel over interstate distances. Ideally, such a transportation vessel should be able to protect the relatively brittle and flimsy fuel rods contained within the fuel assemblies from cracking and rupturing in the event that the vessel is inadvertently exposed to mechanical shock.

It would be highly desirable if the transportation vessel and the basket structure contained therein could be easily and remotely assembled into a mechanically and thermally slack-free structure after the fuel assemblies are loaded therein, and easily and remotely disassembled after the fuel assemblies have been delivered to their final destination. Finally, the transportation vessel should have ample heat conductivity to effectively dissipate the heat generated by the residual radioactivity in the fuel rods.

SUMMARY OF THE INVENTION

Generally speaking, the invention is an improved shipping cask for spent fuel rods of the type having a vessel and a basket structure disposed in the interior thereof for holding an array of spent fuel containers. The improvement comprises the provision of one or more former members between the sides of the basket structure and the side walls of the vessel interior for absorbing mechanical shock applied to the exterior of the vessel, mechanically uniting the basket structure and vessel, and dissipating the heat generated by the residual radioactivity in the fuel rods. Each of the former members includes a plurality of shock-absorbing portions disposed therearound that deformably yield when a mechanical shock of over a selected magnitude is applied to the exterior of the vessel. In the preferred embodiment, the shock absorbing portions are an array of interconnecting ligaments formed by boring an array of mutually parallel holes in the shock-absorbing portions.

The former members may further be formed from a material having a greater thermal coefficient of expansion than the side walls of the vessel so that the heat generated by the spent fuel rods loaded within the basket structure will cause the former members to expand into mechanical engagement between the basket structure and the sidewalls of the vessel interior. To this end, the former members are dimensioned so that the basket structure is freely receivable within the interior of the vessel at ambient temperatures, but becomes frictionally bound within the interior as a result of the greater relative thermal expansion of the former members whenever spent fuel rods are loaded into the basket structure. The basket structure becomes freely removable from the vessel when the interior of the vessel is returned to ambient temperature as, for example, by removal of the spent fuel rods contained therein.

The former members may further include heat conducting portions disposed between the shockabsorbing portions for conducting heat from the spent fuel rods to the vessel walls in order to dissipate it into the ambient atmosphere. In the preferred embodiment, the former members are made from aluminum plates having a round outer diameter that is complementary in shape to the interior of the vessel, and a step-shaped inner perimeter that is complementary in shape to the angular perimeter of the basket structure.

The improved shipping cask of the invention provides a cask that (1) protects the spent fuel rods contained therein from being broken or otherwise damaged by inadvertent mechanical shocks, (2) automatically and remotely unites the basket structure with the interior walls of the vessel by exploiting the relatively greater thermal coefficient of expansion of the aluminum that forms the former plates versus the steel that forms the walls of the vessel, and (3) effectively dissipates the heat generated within the cask to the ambient atmosphere.

BRIEF DESCRIPTION OF THE SEVERAL FIGURES

Figure 5:
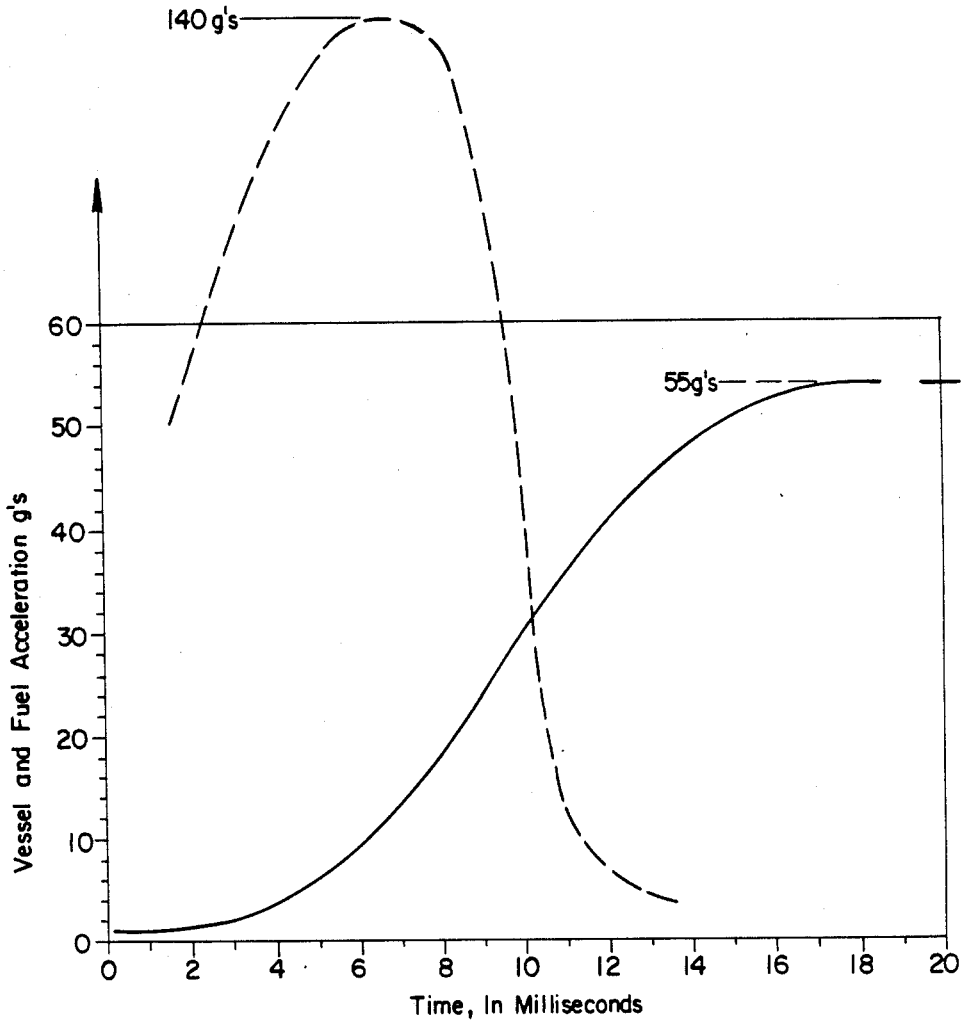
Figure 6:
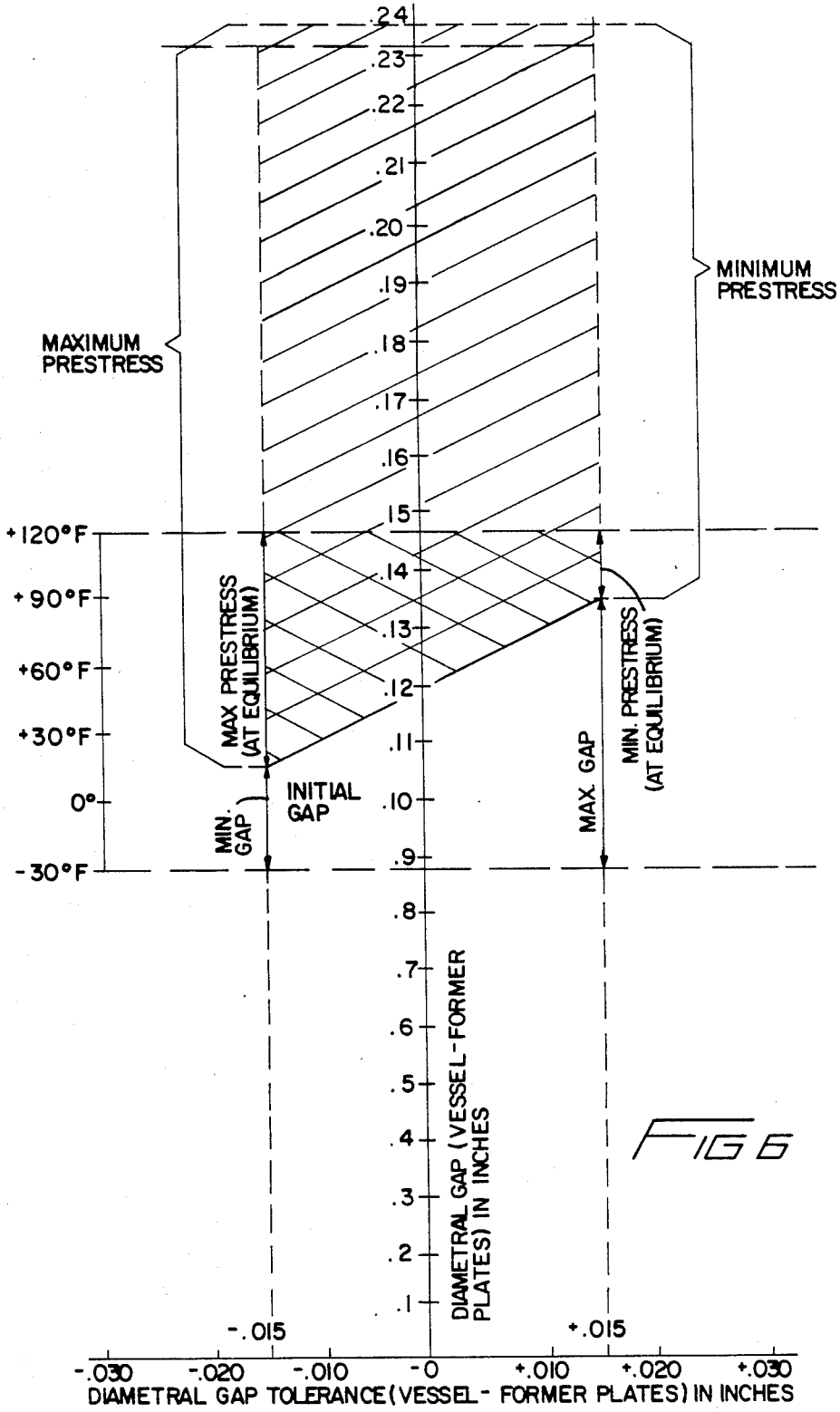

FIG. 5 is a graph illustrating how the shock-absorbing portions of the former plates reduce the peak acceleration forces that the fuel rods would experience in the event of a vessel drop accident, and FIG. 6 is a graph illustrating how the optimum outer dimensions of the former plate may be determined so that the relatively higher thermal expansion of aluminum relative to steel may be exploited to create a simple, unitary basket and vessel structure having good heat transfer qualities without plastic deformation of the former plates.

DETAILED DESCRIPTION OF THE PREFERRED EMBODIMENT

Figure 1:
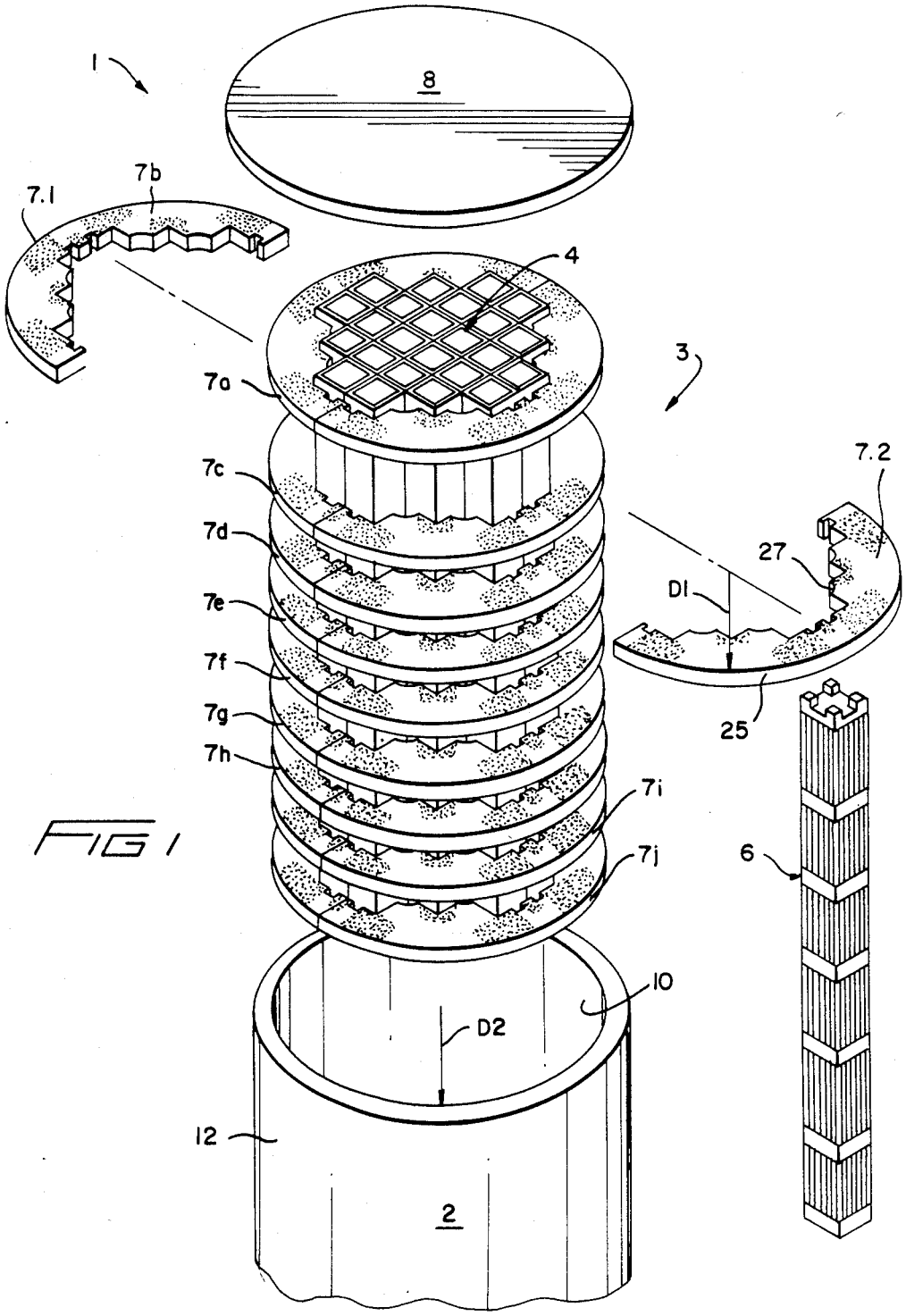
FIG. 1 is an exploded perspective view of the improved basket structure of the transportation cask of the invention.

With reference to FIG. 1, wherein like numerals designate like components of the invention throughout all of the several figures, the transportation cask 1 of the invention includes a cylindrical vessel 2 for containing an improved basket structure 3. The basket structure 3 includes both a cell assembly 4, as well as a plurality of circular former plates *7a–j* that circumscribe the cell assembly 4.

The cylindrical vessel 2 of the transportation cask 1 includes a closure lid 8 which may be detachably mounted around the upper edge of the vessel 2 in a gastight seal. The floor (not shown) of the cylindrical vessel 2 is preferably provided with a plurality of symmetrically arranged drain holes (also not shown) which may be selectively opened for draining water from the interior of the vessel 2. The side walls of the cylindrical vessel 2 of the transportation cask 1 may be made for carbon steel that is approximately twelve inches thick. In the alternative, these walls may be made from a composite of stainless steel, lead, and a neutron-absorbing plastic of a type known in the art that contains a boron compound. On the balance, carbon steel is the preferred material due to its relatively high strength, low cost, and favorable heat conduction qualities. Both the inner wall 10 and outer wall 12 of the vessel 2 are accurately machined into a cylindrical shape.

Figure 2:
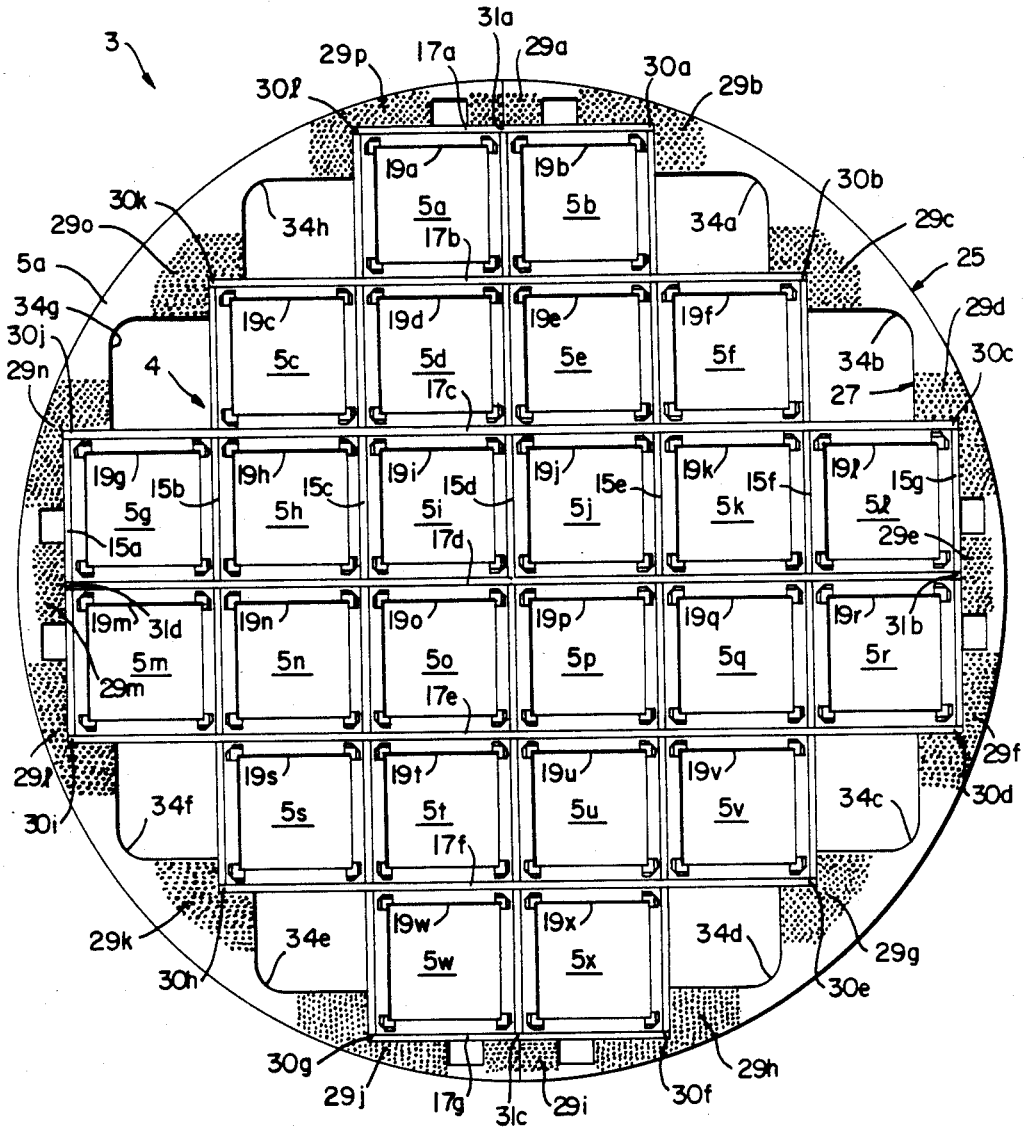
FIG. 2 is a top plan view of the basket structure illustrated in FIG. 1, showing the topmost former plate thereof.
Figure 3:
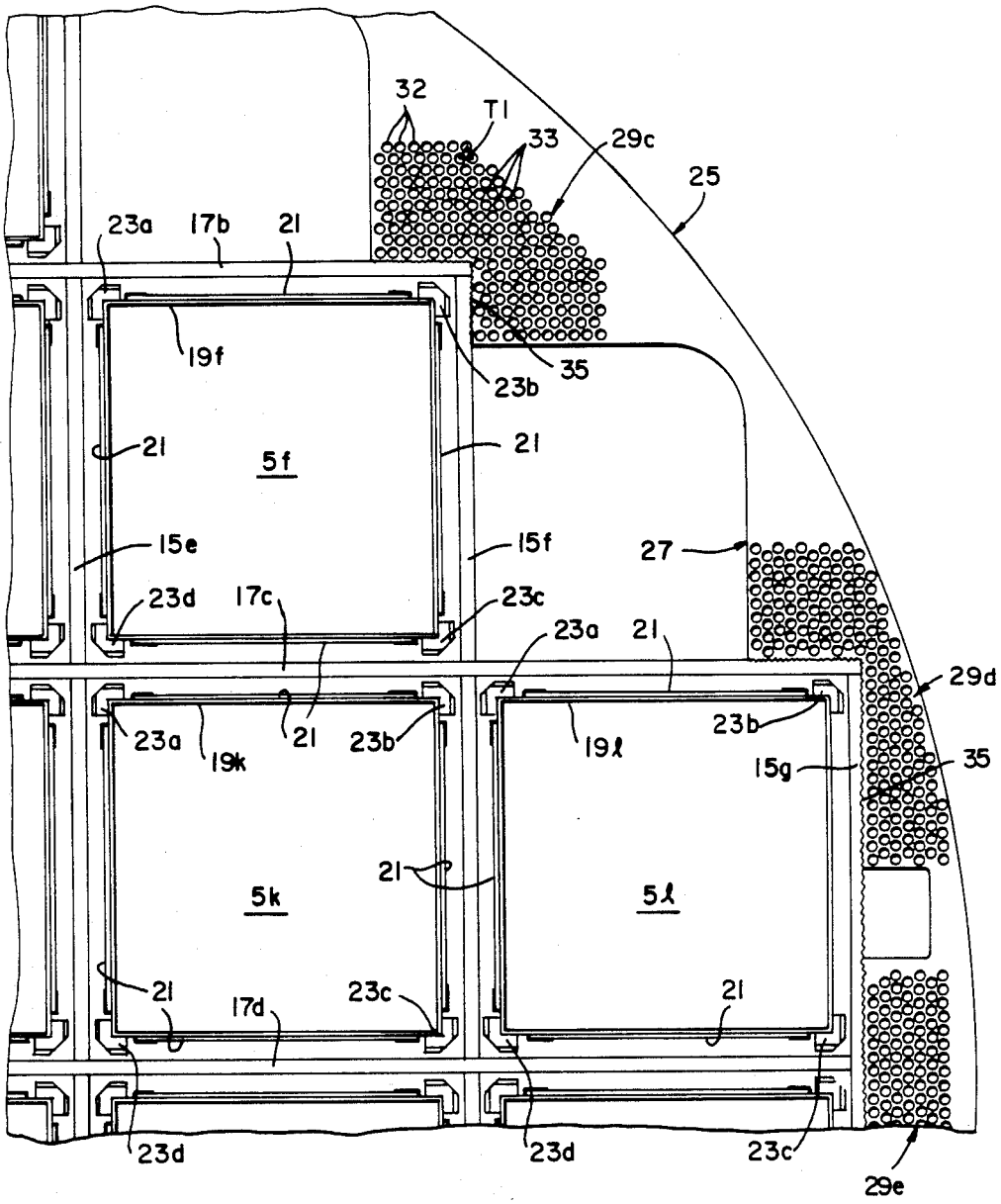
FIG. 3 is an enlarged view of the top former plates of the improved basket structure, illustrating in greater detail some of the ligament structures that constitute the shock-absorbing portions of the plate.

With reference now to FIG. 2, the cell assembly 4 is formed from two seats of parallel plates *15a–g* and *17a–g* which are slotted approximately one-half the distance of their lengths and interfitted in "eggcrate" fashion to define an array of square, elongated cells *5a–x*. The plates *15a–g* and *17a–g* are welded along their entire lengths at every intersection in order to rigidify the structure 4. In the preferred embodiment, each of the plates *15a–g* and *17a–g* is formed from aluminum, although stainless steel may also be used. Disposed in each of the cells *5a–x* defined by the interlocking plates *15a–g* and *17a–g* is an elongated container *19a–x* having a square cross section as shown. As is best seen in FIG. 3, the outside walls of each of these containers *19a–x* is clad with a sheet 21 of Boral® (or other neutron-absorbing material) that is approximately 0.075 inches thick. Mounting brackets *23a–d* disposed in the corners of each of the cells *5a–x* serve to mount and to uniformly space each of the containers *19a–x* from the interior walls of its respective cell *5a–x*. It should be noted that the instant invention is compatible for use with the inventive modular cell assembly 4 described and claimed in co-pending U.S. Ser. No. [to be assigned]for "Improved Basket Structure for a Nuclear Fuel Transportation Cask" by C. Fred Davis, Jr. and assigned to the Westinghouse Electric Corporation, the entire specification of which is incorporated herein by reference.

With reference now to FIGS. 1, 2 and 3, the former plates *7a–j* of the basket structure 3 each have a circular outer edge 25 whose diameter D1 is nearly as large as the inner diameter D2 of the wall 10 of the cylindrical vessel 2, and a stepped inner edge 27 which is generally complementary in shape to the exterior perimeter of the cell assembly 4. Each of the former plates *7a–j* includes a plurality of shock-absorbing portions *29a–p* positioned adjacent to both the outer corners *30a–l* and the outer midsections *31a–d* of the cell assembly 4. As may best be seen with respect to FIG. 3, each of the shock absorbing portions *29a–p* is preferably formed from a plurality of bores 32 which extend completely through the two-inch thickness of the former plates *7a–j*. These bores are arranged in a triangular pitch T1 in order to define a network of ligaments 33 which will yieldably deform when exposed to mechanical shock above a certain magnitude. The use of circular bores 32 (as opposed to bores having a more complicated cross section) facilitates the fabrication of the shock-absorbing portions *29a–p* in each of the former plates *7a–j*. Such circular bores 32 may be easily drilled, or directly molded into the former plates *7a–j* during their manufacture. For former plates approximately 68 inches in diameter and two inches in thickness, the diameter of each of the bores 32 is approximately one-fourth inch. Additionally, the bores are triangularly arranged so that the minimum ligament width is about one-tenth inch.

The inner perimeter 27 of each of the former plates *7a–j* further includes a plurality of angular cut-out portions *34a–h*, as is best seen with respect to FIG. 3. These cut-out portions 34*a–h* serve three functions. First, they simplify the installation of the former plates 7*a–j* around the basket structure 3 by reducing the length of the welds 35 (shown in FIG. 3) that secure these plates around the side walls of the cell assembly 4. Secondly, they significantly reduce the weight of the former plates 7*a–j*. Thirdly, these cut-out portions complement the shock-absorbing function of the portions 29*a–p* by mechanically focusing every major point of contact between the wall of the cell assembly 4 and the inner perimeter 27 of the former plates 7*a–j* into one of the shock-absorbing portions 29*a–p*.

Figure 4A:
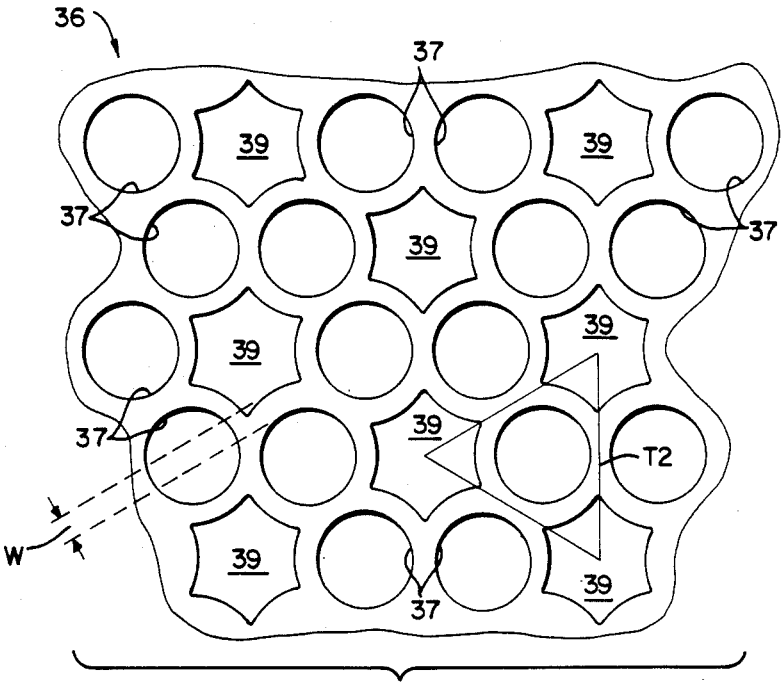
FIGS. 4A and 4B are alternative forms of the ligament structure that forms the shock-absorbing portions of the plate.

FIG. 4A illustrates an alternative ligament structure 36 that may be used to form the shock-absorbing portions 29*a–p* of the former plates 7*a–j*. This particular ligament structure 36 is formed from a plurality of circular bores 37 and six-pointed, star-shaped openings 39 interspersed between one another in a generally triangular pitch T2. While this particular ligament structure 36 is more difficult to fabricate than a ligament structure formed solely from triangularly arranged, circular bores due to the broaching necessary to form the star-shaped openings 38, it advantageously results in individual ligaments 43 that are very nearly the same width W. The substantially identical width of these ligaments 43 in turn gives this alternative ligament structure 36 the ability to deformably yield in a more uniform pattern throughout the area of the shock-absorbing portions 29*a–p* (as viewed in plan) when subjected to mechanical shock over a certain magnitude. Also, the fact that most of the openings that form the ligaments 43 are circular bores 37 facilitates the manufacture of this alternative ligament structure 36.

Figure 4B:
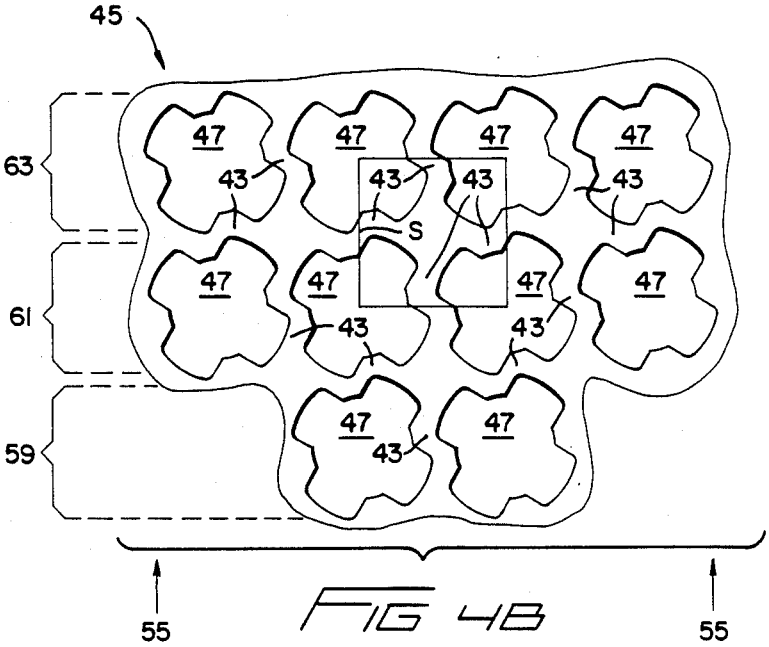

FIG. 4B illustrates a second ligament pattern 45 that may be used to form the shock-absorbing portions 29*a–p* on the former plates 7*a–j*. This particular pattern 45 is formed from a plurality of broached, cloverleaf openings 47 arranged relative to one another in a square pitch S. Such a pattern of cloverleaf openings 47 results in a ligament pattern 45 formed from a plurality of S-shaped ligaments 53. While this particular pattern 45 is more difficult to manufacture than either of the previously described ligament patterns, it offers the advantage of both uniform and controlled yielding. Specifically, if this particular pattern 45 is subjected to a compressive force from the direction of arrows 55, the s-shaped ligaments 53 closest to the compressive force would tend to yieldably and uniformly buckle on a row-by-row basis, depending upon the severity of the mechanical force. Stated otherwise, row 59 would be the first to buckle to a maximum extent, followed by row 61 and then row 63. Such controlled, row-by-row buckling minimizes the amount of deformation of the shock-absorbing portions 29*a–p* nearest the vicinity of the corners 30 and outer midsections 31 of the cell assembly 4, thereby helping to prevent any portion of the cell assembly 4 from becoming bound between the former plates 7*a–j* in the inner wall 10 of the cylindrical vessel 2 in the case of an accident. The prevention of such binding would facilitate the removal of the cell assembly 4 from the vessel 2 in the case of an accident, which in turn would help with the repair of the cask 1 and the recovery of all the fuel rods disposed therein.

FIG. 5 is a graph illustrating how the shockabsorbing portions 29*a–p* reduce the acceleration forces that the fuel rods disposed within the vessel 2 experience when the vessel is subjected to a mechanical shock equivalent to a five-foot drop. Specifically, the smooth curve illustrate the maximum g's that the fuel rods within the transportation cask 1 would experience over time (in milliseconds) with the provision of shock-absorbing portions 29*a–p* in the former plates 7*a–j*, while the dotted line curve illustrates the amount of g's that these rods would experience without such shock-absorbing portions 29*a–p*. As is clear from the graph, the maximum force that the rods experience with the invention is approximately 55 g's, while the maximum force without the invention is 104 g's, which is almost twice as much. The reduction of the acceleration force that the rods experience by approximately fifty percent greatly reduces the number of Zircaloy®-clad fuel rods that will break or otherwise rupture in the event that the transportation cask 1 is exposed to a shock equivalent to a drop of above five feet. This substantial reduction in the amount of broken or ruptured fuel rods makes it much easier for these rods to be recovered from the interior of a cask 1 that experiences such a drop accident since it greatly reduces the amount of free-floating uranium oxide granules and pellet chips within the cask 1. The lowering of these g forces also substantially lowers the amount of mechanical warpage and buckling experienced by the cell assembly 4, which is yet another factor in facilitating the recovery of any fuel rods contained within the containers 19 of the cell assembly 4.

FIG. 6 is a graph illustrating how the optimum outer diameter of the former plates 7*a–j* may be determined so that the relatively higher thermal expansion of aluminum relative to the steel that forms the cylindrical vessel 2 may be exploited to create a simple, self-uniting basket and vessel structure having excellent heat transfer qualities. The abscissa or X-axis of this graph illustrates the manufacturing tolerance on the diametral gap between the outer diameter of the former plates 7*a–j*, and the inner diameter of the wall 10 of the cylindrical vessel 2. The Y-axis or ordinate represents the actual diametral gap between the outer edge of the former plates 7*a–j*, and the inner surface of the wall 10 of the cylindrical vessel 2 in inches. With a vessel inner diameter of approximately 68 inches, the diametral gap between the former plates 7*a–j* and the inner walls 10 of the vessel 2 should be about 0.120 inches at an ambient temperature of approximately 55° F. after thermal equilibrium has been attained. If such a 0.120 inch diametric gap can be achieved within a tolerance of ±0.015 inches, an interference-type engagement between the outer diameter of the former plates 7*a–j* and inner wall 10 of the cylindrical vessel 2 of between about 0.010 inches and between approximately −30° F. and 120° F. The amount by which the interference engagement between the former plates 7*a–j* and the vessel 2 varies as both a function of the tolerance of the diametral gap and the ambient temperatures is represented by the cross-hatch zone in FIG. 6. Basically, this graph indicates that, even when the diametral gap is +0.015 inches larger than the always occur when the internal temperature of the vessel 2 is 90° or over. This graph also indicates that, when the gap is −0.015 inch smaller than the desired 0.120 inch gap sought, an interference engagement will always occur at ambient temperatures of about 10° F. or more. No interference-type engagement occurs below about 10° F., even when the diametral gap is less than 0.120 inches by the full 0.015 tolerance; however, interference-type engagement is not necessary at such low ambient temperatures to keep the cell assembly 4 at an acceptably low temperature.

The single-hatched zone of the graph illustrated in FIG. 6 illustrates the amount of interference-type engagement which occurs between the former plates *7a–j* and the inner wall 10 of the vessel 2 before thermal equilibrium has been attained. Such a state of nonequilibrium exists whenever the cask 1 is loaded with spent fuel rods and drained of water, since the basket structure 3 and former plates *7a–j* heat up much more quickly than the twelve-inch thick walls of the steel cylindrical vessel 2. The amount of interference-type engagement which occurs between the former plates *7a–j* and the inner wall 10 of the cylindrical vessel 2 is an important design consideration, since an excessive amount of interference-type engagement could squeeze the outer edges of the former plates *7a–j* so tightly against the thick steel walls of the cylindrical vessel 2 that the former plates *7a–j* become inelastically deformed. Such inelastic deformation could widen the desired diametral gap of 0.120 inches to an extent so large that the outer edges of the former plates *7a–j* actually disengage from the inner wall 10 of the vessel 2 after equilibrium has been obtained, thereby curtailing the heat flow out of the vessel 2 and allowing the cell assembly 4 to become excessively overheated. The single-hatched zone of the graph illustrated in FIG. 6 indicates that the maximum amount of interference-type engagement between the former plates *7a–j* and the inner wall 10 of the vessel 2 would be approximately 0.13 inches in a worsetolerance scenario wherein the diametral gap is cut. Former plates *7a–j* can withstand such a degree of interference-type engagement if both they and the cell assembly 4 of the basket structure 3 are formed from a relatively high-strength aluminum alloy such as aluminum 6061-T451.

In the preferred embodiment, both the cell assembly 4 and former plates *7a–j* of the basket structure 3 are all formed from the same type of aluminum alloy (i.e., aluminum 6061-T45) for five reasons. Such an alloy is highly heat conductive, which in turn allows the heat from the spent rods in the cell assembly 4 to be readily dissipated through the walls of the cylindrical vessel 2 after thermal equilibrium has been attained. Secondly, the use of a single alloy allows strong and reliable weld joints 35 between the former plates *7a–h* and the outer perimeter of the cell assembly 4. Thirdly, because aluminum alloys are generally fairly soft and easily machined, the drilling of the triangular-pitched bores 32 to form the shock-absorbing ligaments 33 in the shock-absorbing portions 29*a–p* is a relatively easy task. Aluminum is also lightweight, which results in a lower weight for the cask 1 as a whole. This is an important consideration, as a fully loaded cask 1 could weigh between 100 and 200 tons. Finally, because there is a significant thermal differential between the carbon steel that forms the wall of the cylindrical vessel and the aluminum alloy that forms the cell assembly 3 and former plates *7a–j* of the basket structure 3, it is possible to design former plates *7a–j* which automatically become engaged against the inner walls 10 of the vessel 2 after thermal equilibrium has been attained, thereby unitizing the cask 1 and providing ample heat exchange between the spent fuel rods in the basket structure 3 and the air surrounding the outer walls of the cylindrical vessel 2.

While aluminum alloys are the preferred materials, it should be noted that other metals may be used to form the cylindrical vessel 2 and the basket structure 3, respectively, so long as the alloy used to fabricate the basket structure 3 expands a greater amount in response to heat than the alloy used to form the vessel 2. Hence, it would be possible to form both the cylindrical vessel 2 and the basket structure 3 out of different types of steels (i.e., carbon steel vs. various types of stainless steels) and still retain many of the advantages of the invention. Of course, if non-aluminum alloys are used, the preferred diametral gaps would change considerably.

I claim:

1. An improved shipping cask for spent fuel rods of the type having a vessel and a basket structure disposed in the interior thereof for holding a plurality of spent fuel containers, wherein the improvement comprises at least one former member disposed between the sides of the basket structure and the side walls of the vessel interior for both mechanically uniting the basket structure and the vessel, and absorbing mechanical shock applied to the exterior of the vessel to protect the spent fuel rods in the containers, wherein said member includes a shock-absorbing portion that deformably yields when mechanical shock of a magnitude indicative of an accident condition is applied to the outside of the vessel in order to reduce the shock transmitted from the vessel to the basket structure.

2. The shipping cask of claim 1, wherein said member further transfers heat received from the spent fuel rods through the basket structure to the walls of the vessel in order to dissipate said heat.

3. The shipping cask of claim 1, wherein the member is formed from a material having a greater thermal coefficient of expansion than the side walls of the vessel so that the heat generated by spent fuel rods loaded within the containers of the basket structure will cause the member to expand into mechanical engagement between the basket structure and the side walls of the vessel interior, thereby mechanically uniting the basket structure with the vessel.

4. The shipping cask of claim 1, wherein said member is a former plate circumscribing the basket structure that includes at least one shock absorbing portion that deformably yields when mechanical shock of over a selected magnitude is applied thereto.

5. An improved shipping cask for spent fuel rods of the type having a vessel and a basket structure disposed in the interior thereof for holding a plurality of spent fuel containers, wherein the improvement comprises a plurality of former members circumscribing the basket structure that includes shock-absorbing portions which deformably yield when mechanical shock of over a selected magnitude is applied to the vessel exterior in order to reduce the shock transmitted from the vessel to the basket structure.

6. The shipping cask of claim 5, wherein said shock absorbing portions include an array of ligaments.

7. The shipping cask of claim 6, wherein the ligaments of the shock absorbing portions of the former members are formed from an array of bores.

8. The shipping cask of claim 5, wherein the former members include a material having a greater thermal coefficient of expansion that the side walls of the vessel so that the heat generated by the spent fuel rods loaded within the containers of the basket structure will cause the former members to thermally expand into engagement between the basket structure and the side walls of the vessel interior, thereby mechanically uniting the sides of the basket structure with the vessel interior.

9. The shipping cask of claim 5, wherein said members further transfer heat received from the spent fuel rods through the basket structure to the walls of the vessel in order to dissipate said heat.

10. An improved shipping cask for transporting spent fuel rods of the type having a vessel and a basket structure for holding a plurality of spent fuel containers, wherein the improvement comprises a plurality of former members circumscribing the basket structure that include shock absorbing portions formed from an array of ligaments which deformably yield when mechanical shock of a selected magnitude indicative of an accident condition is applied to the vessel exterior in order to reduce the shock transmitted from the vessel to the basket structure.

11. The shipping cask of claim 10, wherein the former members include a material having a greater thermal coefficient of expansion than the walls of the vessel, and said former members are dimensioned so that the basket structure is freely receivable within the interior of the vessel at ambient temperature, but becomes frictionally bound within said interior as a result of the greater relative thermal expansion of the former members whenever spent fuel rods are loaded into the containers of the basket structure.

12. The shipping cask of claim 11, wherein the basket structure becomes freely removable from the vessel when the interior of the vessel returns to ambient temperature.

13. The shipping cask of claim 12, wherein said former members are substantially formed from a thermally conductive material for conducting the heat generated by the spent fuel rods to the vessel in order to dissipate said heat.

14. The shipping cask of claim 10, wherein said array of ligaments are formed from an array of mutually parallel bores.

15. The shipping cask of claim 14, wherein said bores are arranged in a triangular pattern.

16. The shipping cask of claim 11, wherein said former members are substantially formed from aluminum and said vessel is substantially formed from an alloy of iron.

17. The shipping cask of claim 13, wherein said former members also include heat conducting portions between the ligamented shock absorbing portions in order to conduct the heat generated by the spent fuel rods to the vessel in order to dissipate said heat.

18. The shipping cask of claim 10, wherein said array of ligaments is formed from an array of parallel quatrefoil openings.

19. The shipping cask of claim 10, wherein the perimeter of the basket structure includes angular sections that are closer to the walls of the interior of the vessel than other sections, and wherein the shock absorbing portions are positioned around the former members between said angular sections and the interior of the vessel.

20. An improved shipping cask for transporting spent fuel rods, wherein said cask includes a substantially cylindrical vessel and a basket structure removably contained within the vessel for holding a plurality of rectangular spent fuel containers in a mutually parallel array, and whose sides are characterized by a plurality of angular corners and recesses, said corners being closer to the interior wall of the vessel when said basket structure is contained within the vessel, the improvement comprising a plurality of former plates circumscribing the basket structure, wherein the inner edges of said plates are substantially complementary in shape to the angular perimeter of the basket structure and are affixed to said structure, and the outer edges are circular, and wherein the sections of the former plates disposed between the corners of the basket structure and the interior wall of the vessel include a shock absorbing means in the form of weakened plate portions that are yieldably deformable when a mechanical shock of magnitude indicative of an accident condition is applied to the exterior of the vessel in order to reduce the shock transmitted from the vessel to the basket structure.

21. The cask of claim 20, wherein the former plates are formed of a material having a greater thermal coefficient of expansion than the walls of the vessel, and said plates are dimensioned so that the basket structure is freely receivable within the interior of the vessel at ambient temperature, but becomes frictionally bound within said vessel interior as a result of the greater relative thermal expansion of the former plates whenever spent fuel rods are loaded into the rectangular containers of the basket structure.

22. The cask of claim 21, wherein the basket structure becomes unbound from the interior vessel walls upon the removal of the spent fuel rods from the containers and the return of the basket structure to ambient temperature.

23. The cask of claim 20, wherein the sections of the former plates between the shock absorbing sections transfer heat from the spent fuel rods from the basket structure to the vessel in order to dissipate said heat.

24. The cask of claim 21, wherein the former plates are made of aluminum, and the vessel is made of steel

* * * * *